US011370230B2

(12) United States Patent
Toda et al.

(10) Patent No.: US 11,370,230 B2
(45) Date of Patent: Jun. 28, 2022

(54) DEVICE AND LIQUID DISCHARGE APPARATUS

(71) Applicants: Naohiro Toda, Kanagawa (JP); Toshiya Satoh, Kanagawa (JP); Teiichiro Ishikawa, Tokyo (JP); Masaya Hamaguchi, Kanagawa (JP); HuiZee Then, Kanagawa (JP); Hidehisa Shibasaki, Ibaraki (JP); Yoshikane Matsumoto, Ibaraki (JP)

(72) Inventors: Naohiro Toda, Kanagawa (JP); Toshiya Satoh, Kanagawa (JP); Teiichiro Ishikawa, Tokyo (JP); Masaya Hamaguchi, Kanagawa (JP); HuiZee Then, Kanagawa (JP); Hidehisa Shibasaki, Ibaraki (JP); Yoshikane Matsumoto, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/371,731

(22) Filed: Jul. 9, 2021

(65) Prior Publication Data

US 2022/0016906 A1 Jan. 20, 2022

(30) Foreign Application Priority Data

Jul. 15, 2020 (JP) ..... JP2020-121548

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 3/407; B41J 11/0022; B41J 29/377; B41J 15/04; B41J 11/00242
See application file for complete search history.

(56) References Cited

U.S. PATENT DOCUMENTS

| | | | | |
|---|---|---|---|---|
| 2010/0110134 | A1 | 5/2010 | Ohmura et al. | |
| 2015/0258783 | A1 | 9/2015 | Toda et al. | |
| 2016/0101635 | A1* | 4/2016 | Hoshino | B41J 11/0015 347/102 |
| 2019/0283459 | A1 | 9/2019 | Nakamura et al. | |
| 2019/0299692 | A1 | 10/2019 | Toda et al. | |
| 2020/0276839 | A1 | 9/2020 | Satoh et al. | |

FOREIGN PATENT DOCUMENTS

JP 2016-078428 5/2016

* cited by examiner

*Primary Examiner* — Bradley W Thies
(74) *Attorney, Agent, or Firm* — Duft & Bornsen, PC

(57) ABSTRACT

A device includes a temperature control member and a linearly-contact member. The temperature control member has an outer peripheral surface to contact a conveyed substrate to which liquid is applied, and heats or cools the substrate. The linearly-contact member contacts the substrate and the temperature control member on an upstream side from a contact position between the substrate and the temperature control member in a conveyance direction of the substrate.

10 Claims, 5 Drawing Sheets

DEVICE AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-121548, filed on Jul. 15, 2020, in the Japan Patent Office, the entire disclosure of which is incorporated by reference herein.

BACKGROUND

Technical Field

Embodiments of the present disclosure relate to a device and a liquid discharge apparatus.

Related Art

There is known a configuration that a substrate to which a liquid such as ink is applied is heated while being conveyed.

SUMMARY

In an aspect of the present disclosure, there is provided a device that includes a temperature control member and a linearly-contact member. The temperature control member has an outer peripheral surface to contact a conveyed substrate to which liquid is applied, and heats or cools the substrate. The linearly-contact member contacts the substrate and the temperature control member on an upstream side from a contact position between the substrate and the temperature control member in a conveyance direction of the substrate.

In another aspect of the present disclosure, there is provided a liquid discharge apparatus that includes a liquid applier to apply liquid onto the substrate, and the device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
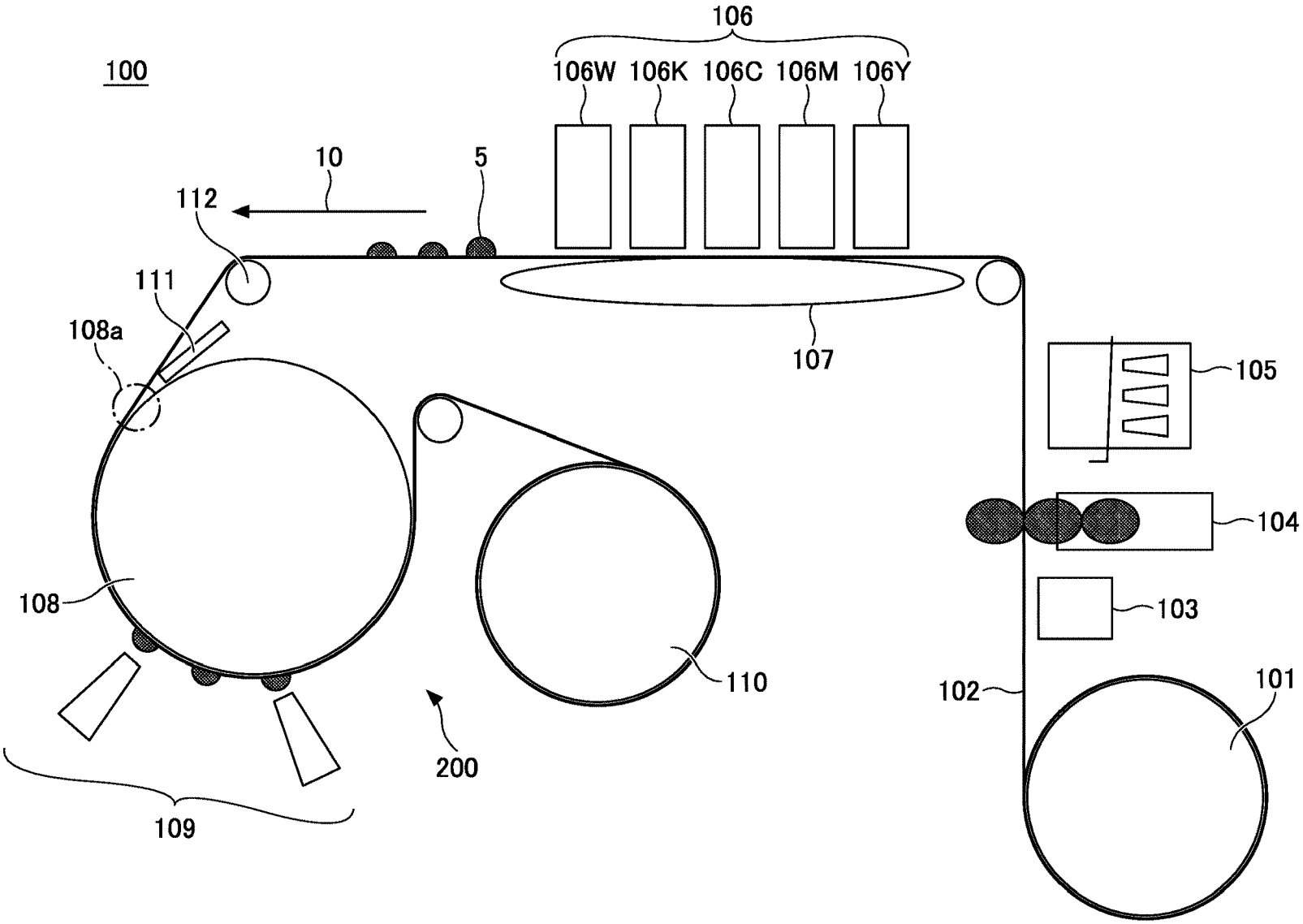
FIG. 1 is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Embodiments of the present disclosure are described below with reference to accompanying drawings. In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

The terms "image forming", "recording", and "printing" are used as synonyms in the embodiments.

In the following embodiments of the present disclosure, an "apparatus to discharge liquid" includes a liquid discharge head or a liquid discharge unit to drive the liquid discharge head to discharge liquid. Note that the "apparatus to discharge liquid" and a "liquid discharge apparatus" are synonymous.

The "apparatus to discharge liquid" may include at least one of devices for feeding, conveying, and ejecting a material to which liquid is adherable. The liquid discharge apparatus may further include at least one of a pre-processing device and a post-processing device.

The "apparatus to discharge liquid" may be, for example, an image forming apparatus that discharges liquid such as ink to form an image on a sheet.

The above-described term "material to which liquid is adherable" denotes a material to which liquid is adherable at least temporarily. Examples of such a material to which liquid is adherable at least temporarily include, but are not limited to, a material to which the adhering liquid is fixed and a material which the adhering liquid permeates.

The "liquid" is not limited to a particular liquid provided that the liquid has a viscosity or a surface tension that allows the liquid to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent such as water or an organic solvent, a colorant such as dye or pigment, a functional material such as a polymerizable compound, a resin, a surfactant, a biocompatible material such as deoxyribonucleic acid (DNA), amino acid, protein, or calcium, and an edible material such as a natural colorant. Such a solution, a suspension, or an emulsion can be used for, e.g., inkjet ink; surface treatment liquid; a liquid for forming an electronic element component, a light-emitting element component, or an electronic circuit resist pattern; or a material solution for three-dimensional fabrication.

The "apparatus to discharge liquid" may be an apparatus to relatively move a liquid discharge head and a material to which liquid is adherable. However, the "apparatus to discharge liquid" is not limited to such an apparatus. The "apparatus to discharge liquid" may be, for example, a serial-type apparatus to move the liquid discharge head relative to a sheet material or a line-type apparatus that does not move a liquid discharge head relative to a sheet material.

The "liquid discharge unit" is an assembly of parts relating to liquid discharge. The term "liquid discharge unit" represents a structure including the liquid discharge head and at least one of a functional part and a mechanism combined to the liquid discharge head to form an integrated unit. For example, "liquid discharge unit" may be a combination of the liquid discharge head and at least one of a head tank, a carriage, a supply mechanism, a maintenance-and-recovery mechanism, and a main scanning moving mechanism.

In the integrated unit, for example, the liquid discharge head and at least one of a functional part and a mechanism may be secured to each other through, e.g., fastening, bonding, or engaging, or one of the liquid discharge head and at least one of a functional part and a mechanism is movably held relative to another. The liquid discharge head and at least one of a functional part and a mechanism may be removable from each other.

For example, the liquid discharge unit may include the liquid discharge head and the head tank that are integrated as a single unit. The liquid discharge head and the head tank may be connected with a tube, thus being integrated as a single unit. A unit including a filter may be added between the head tank and the liquid discharge head.

The liquid discharge unit may include the liquid discharge head and the carriage that are integrated as a single unit.

The liquid discharge head may be held on a guide that is a part of a main scanning moving mechanism, thus being integrated with the main scanning moving mechanism as a single liquid discharge unit. The liquid discharge unit may include the liquid discharge head, the carriage, and the main scanning moving mechanism that are integrated as a single unit.

A cap as a part of a maintenance-and-recovery mechanism is secured to the carriage mounted on the liquid discharge head, thus forming a single unit of the liquid discharge head, the carriage, and the maintenance-and-recovery mechanism.

Tubes are connected to the head tank or the channel member mounted on the liquid discharge head, thus forming a single unit of the liquid discharge head and a supply mechanism. Through the tubes, the liquid of a liquid storage source is supplied to the liquid discharge head.

Examples of the main scanning moving mechanism include a single guide. Examples of the supply mechanism include a single tube and a single loading port.

The "liquid discharge head" is the functional part that discharges and jets liquid from nozzles.

Examples of a source for generating energy to discharge liquid include a piezoelectric actuator (a laminated piezoelectric element or a thin-film piezoelectric element), a thermal actuator that employs an electrothermal transducer element such as a heat element, and an electrostatic actuator including a diaphragm and opposed electrodes.

Hereinafter, in the embodiment, following describes, as an example, a case where the "material to which liquid is adherable" is a film, the "liquid" is ink, and the "apparatus to discharge liquid" is an inkjet image forming apparatus using a line head. The film is used in food packaging applications and the like. The film is a thin film-shaped substrate made of plastics such as polyethylene terephthalate. The film is non-permeable substrate. The film is an example of the substrate. The substrate is not limited to the above-described substrate. Examples of the substrate include, but are not limited to, coated paper and plain paper.

A description is now given of a first embodiment of the present disclosure. Initially with reference to FIG. 1, a description is given of a configuration of an image forming apparatus according to the first embodiment.

FIG. 1 is a schematic diagram illustrating a configuration of an image forming apparatus according to an embodiment of the present disclosure.

As illustrated in FIG. 1, an image forming apparatus 100 includes a feeding device 101, a corona processing device 103, a pre-coat liquid applying device 104, a pre-coat liquid drying device 105, an inkjet discharge head 106, a platen 107, a temperature control drum 108, a warm-air drying unit 109, and the winding device 110. FIG. 1 illustrates an example in which an image is formed on a film 102 in the image forming apparatus 100.

In the present embodiment, the feeding device 101 is used as a feeder of the film 102, whereas the winding device 110 is used as a winder of the film 102. The feeding device 101 is driven to rotate to supply the film 102 stored in a roll shape to a conveyance passage of the image forming apparatus 100.

The winding device 110 rotates to wind up the film 102 on which an image is formed with ink and stores the film 102 in a roll-shape.

The film 102 is a substrate that is continuous along a conveyance direction 10 in which the film 102 is conveyed in the image forming apparatus 100. The film 102 is conveyed along the conveyance passage between the feeding device 101 and the winding device 110. A length of the film 102 in the conveyance direction 10 is greater than at least a length of the conveyance passage between the feeding device 101 and the winding device 110. As described above, continuous long-time printing can be performed on the continuous film 102 along the conveyance direction 10 of the image forming apparatus 100.

A corona processor performs corona treatment on the film 102 by corona discharge to modify the surface of the film 102. In the present embodiment, the corona processing device 103 is illustrated as the corona processor.

The corona treatment is not essential and does not have to be performed. However, the corona treatment is preferably performed before applying a pre-coat liquid to the film 102 to enhance the adhesion of a pre-coat layer to the film 102. Instead of the corona treatment, atmospheric pressure plasma treatment, frame treatment, ultraviolet irradiation treatment may be performed, for example.

As a device to perform the corona treatment, various known devices can be used. Various conditions (for example, discharge amount of corona) of the corona treatment are not particularly limited and can be appropriately changed.

A pre-coating liquid applier is a device to apply a pre-coating liquid to the film 102. In the present embodiment, the pre-coating liquid applying device 104 is illustrated as the pre-coating liquid applier. The pre-coating liquid applying device 104 can apply the pre-coating liquid to the surface of the film 102 by rotationally driving the roller to which the pre-coating liquid is attached so as to come into contact with the film 102. Alternatively, the pre-coating liquid applying device 104 may apply the pre-coating liquid by various known ways such as spin coating, spray coating, gravure roll coating, reverse roll coating, bar coating, inkjet, and the like, can be applied to the application of the pre-coating liquid.

The pre-coating liquid is applied onto the film 102 to form a pre-coating layer on the film 102. The pre-coating layer is also referred to as a "surface treatment layer", for example. The film 102 is heated after the application of the pre-coating liquid on the film 102 to promote formation of the pre-coating layer. Application of the pre-coating liquid onto the film 102 can enhance a lamination strength at time of laminating a lamination film onto an image formed on the film 102 with color ink and white ink. Thus, a good soft package can be obtained.

A liquid applying device is a device that discharges ink to apply the ink onto the film 102 to which the pre-coating liquid has been applied. In the present embodiment, as illustrated in FIG. 1, an inkjet discharge head 106 is used as a liquid applying device.

Each of the inkjet discharge heads 106 includes a plurality of nozzle arrays in which a plurality of nozzles are disposed to discharge ink from the plurality of nozzles toward the film 102. Thus, the inkjet discharge head 106 sequentially discharges liquid of colors of magenta (M), cyan (C), yellow (Y), black (K), and white (W) to the pre-coating layer on the film 102. The order of discharge can be changed as appropriate. In FIG. 1, ink 5 indicates ink discharged and applied onto the film 102 by the inkjet discharge head 106.

The inkjet discharge heads 106 are line-type (full line-type) inkjet discharge heads. The "line-type inkjet discharge head" is an ink discharge head including the plurality of nozzles to discharge ink over an entire width of the film 102, that is, an entire length of the film 102 in a width direction of the film 102 orthogonal to the conveyance direction 10. The width of the inkjet discharge head 106 can be determined as appropriate.

In industrial printing, a large amount of printing is performed at high speed. Therefore, inkjet printing using a line-type inkjet discharge head as illustrated in FIG. 1 is preferable. On the other hand, in the industrial printing, printing is continuously performed for a long time. Therefore, when a line head is used, ink dries in some nozzles from which ink is not discharged for a long time, resulting in poor ejection.

Thus, in an ink application process, it is preferable to vibrate an interface of the ink inside the nozzles that do not discharge ink. The inkjet discharge head in the present disclosure vibrates the interface of the ink inside the nozzle to mix the ink in the nozzle and the ink in an ink channel in the inkjet discharge head 106 such as a pressure chamber communicating with the nozzle to be uniform. Thus, the inkjet discharge head 106 can prevent drying of the ink in the nozzles. Thus, the inkjet head can further reduce an occurrence of abnormal images due to poor ejection. Here, the "interface of ink in the nozzle" is an interface between atmosphere (or gas) and an ink in contact with the atmosphere (or gas).

In the inkjet discharge heads 106, a device to apply a stimulus to the ink to discharge the ink may be appropriately selected according to the purpose, and examples of such a device include a pressure device, a piezoelectric element, a vibration generator, an ultrasonic oscillator, and light. Specifically, the device may be a piezoelectric actuator such as piezoelectric elements, a shape-memory alloy actuator using metallic-phase change due to temperature change, an electrostatic actuator using electrostatic force, and the like.

Particularly, the device using the piezoelectric actuator is preferable. The ink discharge head including the piezoelectric actuator applies a voltage to a piezoelectric element attached to a position called a pressure chamber (also referred to as a liquid chamber) located in an ink channel in the inkjet discharge head. Thus, the piezoelectric element bends and a volume of the pressure chamber is reduced so that the ink in the pressure chamber is pressurized to be discharged from the nozzles of the inkjet discharge head as ink droplets.

In a plurality of nozzles capable of discharging such ink, it is preferable to apply a minute voltage to the piezoelectric element in a degree not discharging the ink for a part of nozzles from which ink is not to be discharged according to a shape of the image to be formed on the film 102. The minute voltage vibrates the interface of the ink in the part of nozzles from which ink is not discharged.

The image forming apparatus (as inkjet recording apparatus) 100 according to the present disclosure discharges the color ink after the application of the pre-coating liquid on a substrate (e.g., the film 102) and thus can reduce bleeding at a color boundary in the image and obtain a good image. When the pre-coating liquid contains a coagulant, by ejecting the color ink after applying the pre-coating liquid, the coagulant in the pre-coating layer and the color material in the color ink are agglomerated while the color ink is wet and spread. A more excellent image can be obtained by restraining the occurrence of streaks in the image and further restraining the bleeding at a color boundary in the image.

Although related to other steps, the printing speed in the image forming apparatus 100 is preferably from 30 m/minute to 100 m/minute. In this case, the image forming apparatus 100 can be suitably used in industrial applications requiring high-speed printing.

The platen 107 guides the film 102 such that the film 102 is conveyed along the conveyance passage. In addition to the conveying roller 112, an unsigned conveying roller is used as a conveyor. The conveyor, the feeding device, and the winding device construct a substrate conveyor.

The present embodiment has a particularly good effect on a non-permeable substrate such as the film 102. The non-permeable substrate refers to a substrate having a surface with a relatively low moisture permeability, absorbability, and/or adsorptivity. The non-permeable substrate may be a material having a number of cavities inside or a material having no opening to the exterior. More quantitatively, the non-permeable substrate refers to a substrate that absorbs water in an amount of 10 $mL/m^2$ or less from the start of contact to 30 $msec^{1/2}$ thereafter, when measured according to the Bristow's method.

As the non-permeable substrate, a polypropylene film, a polyethylene terephthalate film, or a nylon film is particularly preferable because the ink adheres well. Specific examples of the polypropylene film include, but are not limited to: P-2002, P-2161, and P-4166 (available from Toyobo Co., Ltd.); PA-20, PA-30, and PA-20W (available from SunTox Co., Ltd.); and FOA, FOS, and FOR (available from Futamura Chemical Co., Ltd.).

Specific examples of the polyethylene terephthalate film include, but are not limited to: E-5100 and E-5102 (available from TOYOBO CO., LTD.); P60 and P375 (available from TORAY INDUSTRIES, INC.); and G2, G2P2, K, and SL (available from TOYOBO FILM SOLUTIONS LTD.).

Specific examples of the nylon film include, but are not limited to: HARDEN FILM N-1100, N-1102, and N-1200 (available from TOYOBO CO., LTD.); and ON, NX, MS, and NK (available from UNITIKA LTD.).

A dryer dries the ink on the film 102 after the ink is discharged. In FIG. 1, a dryer 200 includes a temperature control drum 108, the warm-air drying unit 109, and a plate-shaped member 111. The dryer 200 is an example of a "device".

The temperature control drum 108 is a rotatable drum. The temperature control drum 108 is an example of a temperature control member that heats or cools the film 102 by bringing an outer peripheral surface of the temperature control member (or the temperature control drum 108) into contact with the conveyed film 102 to which ink is applied.

Examples of a temperature control method using the temperature control drum 108 include a method of heating or cooling the film 102 using the liquid or gas filled inside the temperature control drum 108 as a heat exchange medium. The liquid or gas inside the temperature control drum 108 is maintained at a specified temperature by circulating between the temperature control drum 108 and an external device such as a chiller disposed outside the temperature control drum 108. By exchanging heat with the liquid or gas, the film 102 is heated or cooled. Thus, the temperature of the film 102 is adjustable to a specified temperature.

The liquid flowing inside the temperature control drum 108 is not particularly limited as long as the liquid has fluidity such as water or oil. Water that is easy to handle is desirable. It is desirable from the viewpoint of cost and safety to use heated air as the gas to flow inside the temperature control drum 108.

The liquid or gas that circulates between the temperature control drum 108 and an external device such as a chiller is sucked into the temperature control drum 108 and discharged to the outside via valves disposed at both ends of the temperature control drum 108 in the direction orthogonal to the conveyance direction 10.

However, the method is not limited to the method described above. A heating member such as an IR heater or a halogen heater may be disposed inside the temperature control drum 108 to adjust the temperature of the film 102 by the heat from the heating member.

The warm-air drying unit 109 is disposed facing the outer peripheral surface of the temperature control drum 108, and includes a nozzle having an opening extending in the width direction of the temperature control drum 108. The warm-air drying unit 109 heats the film 102 and dries the ink on the film 102 by blowing warm air from the nozzle onto the film 102 wound around the temperature control drum 108. Although FIG. 1 illustrates an example in which the number of nozzles is two, more nozzles may be disposed along a circumferential direction of the temperature control drum 108. In place of the warm-air drying unit 109 or in addition to the warm-air drying unit 109, an infrared heater may be provided to irradiate the surface of the film 102 with infrared rays to dry the ink on the film.

As described above, in the present embodiment, the temperature control drum 108 heats or cools a surface (back face) of the film 102 opposite a surface (front face) to which the ink is applied while the warm-air drying unit 109 heats or cools the front face of the film 102, to heat the film 102 from both sides of the film 102.

When the film 102 is heated from both sides of the film 102, the overall temperature of the film 102 in the thickness direction is dominated by the heater (the temperature control drum 108 or the warm-air drying unit 109) having the larger thermal capacity. Therefore, when a liquid having a large thermal capacity is used as the heat exchange medium in the temperature control drum 108, the overall temperature of the film 102 is controlled by the temperature of the temperature control drum 108.

As the warm air temperature of the warm-air drying unit 109 increases, the drying efficiency of the ink on the film 102 increases. If the heating temperature is too high, the film 102 may be damaged, resulting in, e.g., thermal deformation. Therefore, when the temperature of the temperature control drum 108 is higher than the temperature of the warm-air drying unit 109, the overall temperature of the film 102 is dominated by the temperature of the temperature control drum 108. Thus, the damage of the film 102 can be restrained.

For example, in an experiment in which the temperature of the liquid in the temperature control drum 108 was 70° C. and the temperature of the warm-air drying unit 109 was 300° C., the temperature of the back face of the film 102 was 85° C. and the temperature of the ink on the front face of the film 102 is 150° C. That is, while the ink on the film 102 is heated to not lower than 100° C., which is the boiling point of the water-based ink, the temperature of the film 102 can be maintained at 100° C. or lower, which is a general heat-resistant temperature. As a result, the configuration described above can accelerate drying of the ink while restraining a heat damage of the film 102.

The temperature of the liquid or gas inside the temperature control drum 108 is preferably in a range of from 50° C. to 100° C.; whereas the temperature of the warm air by the warm-air drying unit 109 is preferably in a range of from 100° C. to 170° C. Since the temperature of the warm-air drying unit 109 is 50 to 100 degrees higher than the temperature of the temperature control drum 108, particularly good drying characteristics can be obtained in promoting the drying of the ink while restraining the heat damage of the film 102. The speed of the warm air blown by the warm-air drying unit 109 is preferably in a range of from 10 to 30 m/s.

A plate-shaped member 111 is an example of a "linearly-contact member" that linearly contacts both the film 102 and the temperature control drum 108 at a position upstream from a contact position 108*a* (indicated by a broken circle in FIG. 1) between the film 102 and the temperature control drum 108 in the conveyance direction 10. The plate-shaped member 111 is disposed between the contact position 108*a* and the conveying roller 112 (as an example of an upstream support member) disposed adjacent to the plate-shaped member 111 and upstream from the contact position 108*a* in the conveyance direction.

Figure 2:
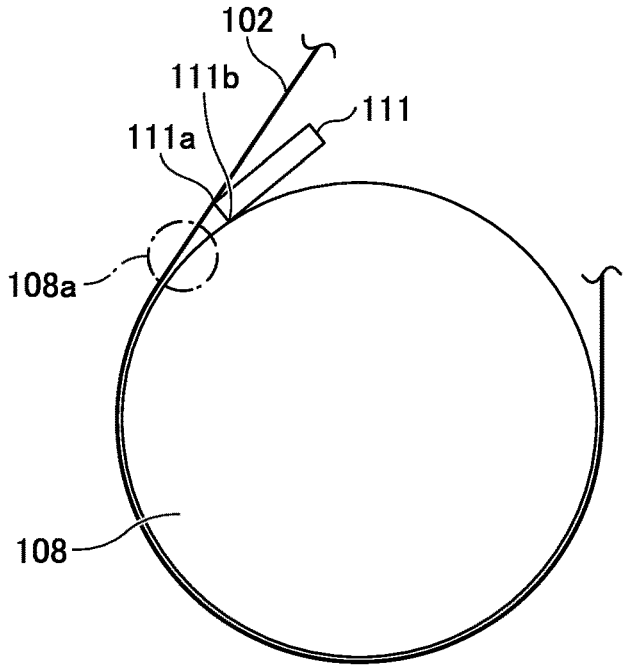
FIG. 2 is an enlarged diagram illustrating a periphery of a plate-shaped member.

The above-described "linearly contacts" means that a contact area between the plate-shaped member 111 and the film 102 extends linearly. FIG. 2 is an enlarged diagram illustrating a periphery of the plate-shaped member 111 in FIG. 1. In FIG. 2, a corner portion 111*a* of the plate-shaped member 111 is in contact with the film 102. The contact area between the plate-shaped member 111 and the film 102 linearly extends along the width direction of the film 102. On the other hand, a corner portion 111*b* of the plate-shaped member 111 is in contact with the temperature control drum 108. The contact area between the plate-shaped member 111 and the temperature control drum 108 linearly extends in the width direction of the film 102.

The plate-shaped member 111 thus disposed allows the plate-shaped member 111 to block the flow of air caused by the rotation of the temperature control drum 108. As a result, the intrusion of air between the film 102 and the temperature control drum 108 is reduced. Further, reducing the intrusion of air enhances the adhesion between the film 102 and the temperature control drum 108 and reduces the temperature unevenness of the film 102 caused by the air interposed between the film 102 and the temperature control drum 108.

As in the present embodiment, in a configuration in which the warm-air drying unit 109 is disposed to face the temperature control drum 108, when the temperature of the warm air blown by the warm-air drying unit 109 is higher than the temperature of the temperature control drum 108, the temperature of the film 102 may rise in void areas in which the film 102 and the temperature control drum 108 are not in close contact with each other and causes wrinkles in the film 102. Such wrinkles can be reduced by arranging the plate-shaped member 111.

As long as the plate-shaped member 111 can linearly contact the temperature control drum 108, any shape of the plate-shaped member 111 can be applied. The thinner the plate-shaped member 111, the closer the plate-shaped member 111 can be disposed to the contact position 108*a*, and the air flow can be restrained more preferably.

Specifically, the thickness of the plate-shaped member 111 is desirably 30 μm or more and 300 μm or less. The material of the plate-shaped member 111 is not particularly limited. Using a stainless-steel material or a ceramic material is particularly preferable to the plate-shaped member 111. The plate-shaped member 111 made of stainless-steel or ceramic is less likely to be deformed and therefore is particularly preferable to obtain reliable stability and durability.

The linearly extending portion of the plate-shaped member 111 may not be entirely in contact with the film 102 and the temperature control drum 108, and may have a non-contact portion.

When the plate-shaped member 111 is disposed so as to make linear contact with both the film 102 and the temperature control drum 108 in a direction parallel to the width direction of the film 102, air intrusion between the film 102 and the temperature control drum 108 can be suitably restrained. However, the plate-shaped member 111 and the film 102 (or the plate-shaped member 111 and the temperature control drum 108) are not always necessary to be parallel, and the plate-shaped member 111 may be disposed to linearly contact both the film 102 and the temperature control drum 108 in a direction intersecting the width direction of the film 102.

It is preferable to form a resin layer made of at least one of fluororesin and silicone resin fine particles on at least an end portion (hereinafter referred to as a contact end) of the plate-shaped member 111, the contact end being in contact with the film 102 and the temperature control drum 108.

Figure 3:
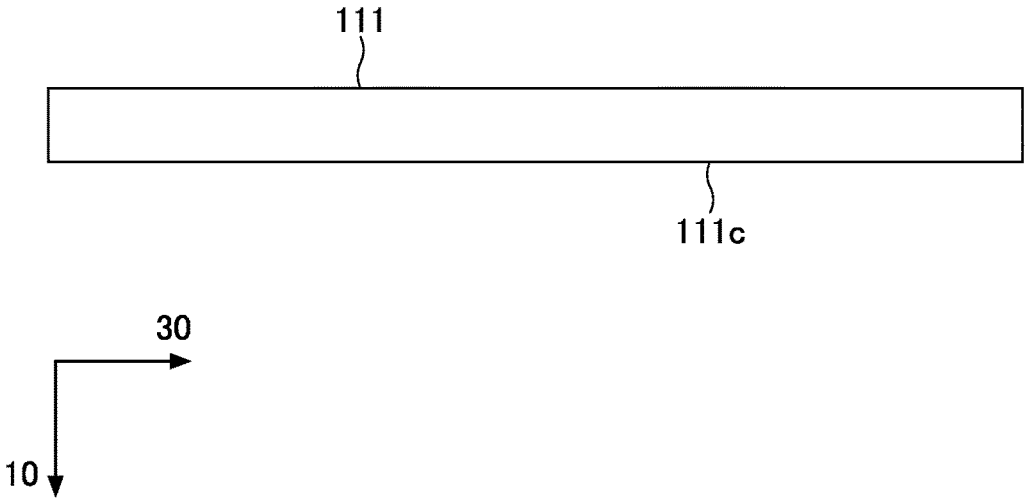
FIG. 3 is a diagram illustrating a contact end of the plate-shaped member on which a resin layer is formed.

FIG. 3 is a diagram illustrating an example of the contact end of the plate-shaped member 111 on which a resin layer is formed. FIG. 3 illustrates the conveyance direction 10 of the film 102 and a width direction 30 of the film 102, together with the contact end of the plate-shaped member 111. FIG. 3 is a plan view of the plate-shaped member 111 as viewed in a direction orthogonal to a plane portion of the plate-shaped member 111 (that is, a direction orthogonal to the conveyance direction 10 and the width direction 30).

A resin layer made of at least one of fluororesin and silicone resin fine particles is formed on the surface of at least a contact end 111*c* of the plate-shaped member 111. The resin layer may be formed not only on the contact end 111*c* but also in a peripheral area of the contact end 111*c* of the plate-shaped member 111. Alternatively, the resin layer may be formed on an entire surface of the plate-shaped member 111.

By forming such a resin layer, the frictional force due to the contact between the plate-shaped member 111 and the film 102 and between the plate-shaped member 111 and the temperature control drum 108 can be reduced, and the plate-shaped member 111 can be prevented from displacement or deformation.

As the fluororesin, Polytetrafluoroethylene (PTFE), tetrafluoroethylene-perfluoroalkylvinylether copolymer (PFA), ethylene tetrafluoro ethylene (ETFE) resin and the like can be used. Particularly, PTFE and PFA are desirable in terms of the effect of reducing frictional force and wear resistance. Such a resin layer can be formed by applying a paint containing above-described resin to the contact end 111*c* of the plate-shaped member 111 by, e.g., spray coating or immersion coating.

Silicone resin fine particles that the siloxane bond forms a three-dimensional crosslink and are made into fine particles can be used. The particle size of the fine particles is preferably from 0.1 μm to 10 μm. A resin layer can be formed by applying a paint including above-described silicone resin fine particles to the contact end 111*c* of the plate-shaped member 111. The resin layer made of the silicone resin fine particles can enhance the releasability of the plate-shaped member 111, and the friction between the plate-shaped member 111 and the temperature control drum 108 can be reduced by an action of the fine convex shape of the fine particles existing inside the resin layer.

A description is now given of operational advantages attained by the image forming apparatus 100.

Figure 4:
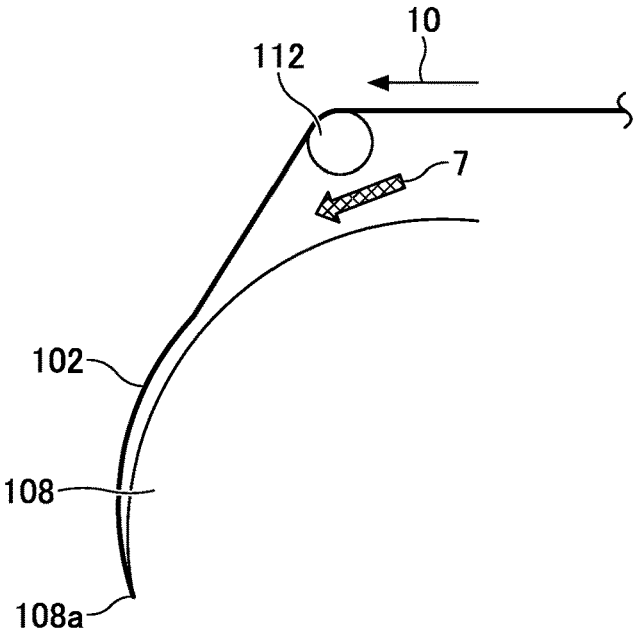
FIG. 4 is a diagram illustrating an intrusion of air between a temperature control drum and a film.

FIG. 4 is a diagram illustrating an intrusion of air between the temperature control drum 108 and the film 102. When the conveying speed of the film 102 increases, an airflow 7 drawn between the film 102 and the temperature control drum 108 increases upstream from the contact position 108*a* in the conveyance direction 10, thus facilitating the intrusion of air between the film 102 and the temperature control drum 108.

Figure 5:
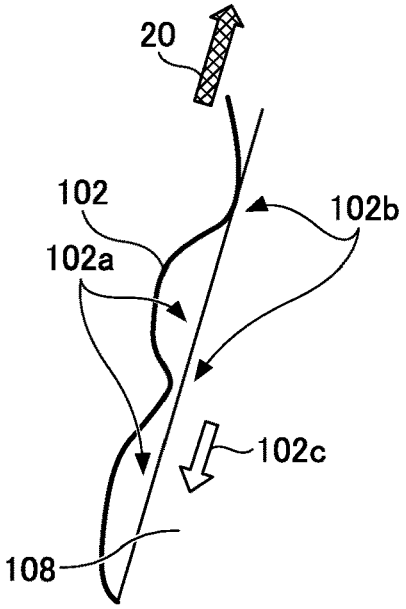
FIG. 5 is a diagram illustrating an example in which air is interposed between the temperature control drum and the film of FIG. 4.

FIG. 5 is a diagram illustrating an example in which air is interposed between the temperature control drum 108 and the film 102 of FIG. 4. FIG. 5 is a diagram illustrating an example of a state in which a void area 102*a* where air is interposed between the temperature control drum 108 and the film 102. In the void area 102*a*, the film 102 and the temperature control drum 108 are not in contact with each other.

Since the heat is transferred to the film 102 through a contact area 102*b* between the film 102 and the temperature control drum 108, the heat transferred through a non-contact area is extremely small. Therefore, if air enters between the film 102 and the temperature control drum 108 and enlarges (increases) the void area 102*a*, the amount of heat transferred may decrease and the drying efficiency may decrease.

As described above, the temperature control drum 108 having a larger thermal capacity than the warm air of the warm-air drying unit 109 acts to restrain damage to the film 102. When the area of the void area 102*a* is enlarged, the cooling effect of the temperature control drum 108 is reduced, and the overall temperature of the film 102 in the thickness direction of the film 102 approaches the warm air temperature. If the temperature of the warm air is higher than the softening point of the film 102, the film 102 may be thermally deformed and wrinkles may occur in the film 102.

Further, in the contact area 102*b* between the film 102 and the temperature control drum 108, a static friction force is generated in a direction indicated by a white arrow 102*c* in FIG. 5. This static frictional force is a reaction force, and even if the feeding device 101 (see FIG. 1) applies tension in a direction indicated by an arrow 20, the tensile stress on the film 102 is reduced. However, when the void area 102*a* is increased, the static friction force is reduced and the effect of reducing the tensile stress on the film 102 is reduced. As a result, a large tensile stress is applied to the film 102 in a state where the heat amount of the warm air from the warm-air drying unit 109 is applied, and the film 102 may be further easily deformed by the synergistic stress of the heat amount and the tensile stress.

In the present embodiment, the plate-shaped member 111 linearly contacts both the film 102 and the temperature control drum 108 at a position upstream, in the conveyance direction 10, from the contact position 108*a* between the film 102 and the temperature control drum 108.

Since the plate-shaped member 111 blocks the flow of air caused by the rotation of the temperature control drum 108, the intrusion of air between the film 102 and the temperature control drum 108 is reduced. Further, by reducing the intrusion of air, the adhesion between the film 102 and the temperature control drum 108 is improved, and wrinkles of the film 102 due to the temperature rise in the portion not in close contact with the temperature control drum 108 can be reduced.

Further, by increasing the adhesion between the film 102 and the temperature control drum 108, the amount of heat transferred from the temperature control drum 108 to the film 102 increases, and the drying efficiency can be improved.

An increased contact area between the film 102 and the temperature control drum 108 increases a static friction force, thus reducing the tensile stress on the film 102 and suitably restraining the deformation of the film 102.

As the "linearly-contact member" that linearly contacts both the substrate and the temperature control member, a tapered member that is thinner as approaching the contact position between the substrate and the temperature control member can also be used.

Figure 6:
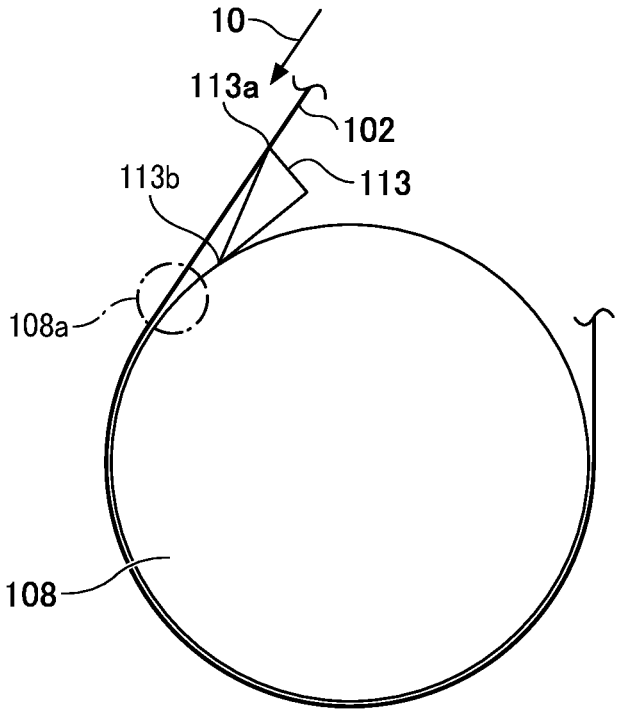
FIG. 6 is a diagram illustrating a configuration of a tapered member.

FIG. 6 is diagram illustrating an example of a configuration of a tapered member 113. The tapered member 113 is a tapered member that is disposed upstream from a contact position 108*a* between the film 102 and the temperature control drum 108 in the conveyance direction 10 and is thinner as approaching the contact position 108*a*. Further, a corner portion 113*a* of the tapered member 113 is in contact with the film 102, whereas a corner portion 113*b* of the tapered member 113 is in contact with the temperature control drum 108.

The tapered member 113 having end portions in a tapered shape reduces the frictional force associated with the contact between the tapered member 113 and the temperature control drum, and the deformation of the tapered member 113 can be restrained. The tapered member 113 is not limited to a shape having a symmetrical taper angle, and may be formed in a knife-edge shape having an asymmetric taper angle.

Figure 7:
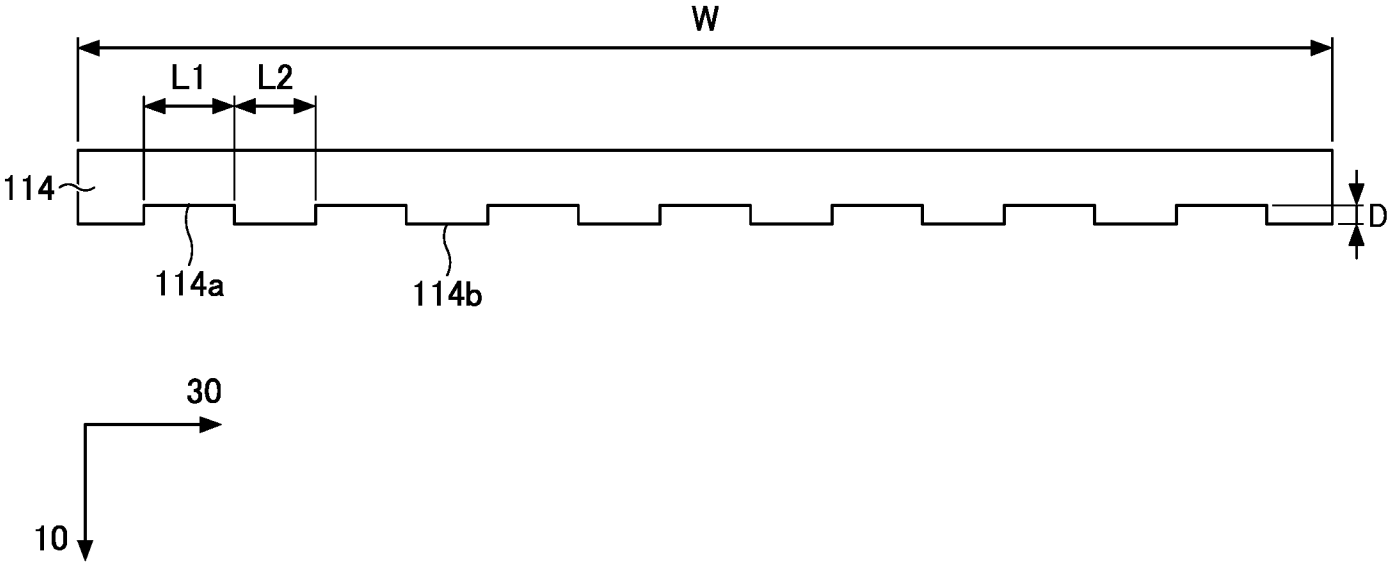
FIG. 7 is a diagram illustrating a configuration of a concave having a concave end portion.

Further, the "linearly-contact member" can be formed in a shape having a cavity at an end portion of the member. FIG. 7 is a diagram illustrating an example of a configuration of a member 114 in which the concave portion is formed at the end as an example of the cavity. FIG. 7 illustrates the conveyance direction 10 of the film 102 and a width direction 30 of the film 102, together with the contact end of the plate-shaped member 111. FIG. 7 is a plan view of the member 114 as viewed in a direction orthogonal to a plane portion of the member 114 (that is, a direction orthogonal to the conveyance direction 10 and the width direction 30). The member 114 is the plate-shaped member, and seven concave portions 114*a* are formed at one end thereof. Contact portions 114*b* other than the concave portions 114*a* at the end of the member 114 are portions that contact the film 102 and the temperature control drum 108. In the example of FIG. 7, the number of contact portions 114*b* is eight.

By disposing the concave portions 114*a*, the contact area of the contact portions 114*b* that contact the film 102 and the temperature control drum 108 can be reduced. By reducing the frictional force due to the reduction of the contact area, the member 114 can be prevented from displacement or deformation.

Further, a total length L1 of the concave portions 114*a* in the width direction 30 is preferably 30% or more and 70% or less of a width W of the film 102. That is, in the example of FIG. 7, it is preferable that $0.3\times W<7\times L1<0.7\times W$ is satisfied.

In other words, since a total length L2 of the contact portions 114*b* is complementary to the total length L1 of the concave portions 114*a*, in the width direction 30, the total length L2 of the contact portions 114*b* is preferably larger than 30% and smaller than 70% of the width W of the film 102. That is, in the example of FIG. 7, it is preferable that $0.3\times W<8\times L2<0.7\times W$ is satisfied.

Further, a depth D of the concave portions 114*a* is preferably 100 μm or less.

Under such conditions, the frictional force due to the contact between the member 114 and the film 102 and between the member 114 and the temperature control drum 108 can be reduced, and the member 114 can be suitably prevented from displacement or deformation. Although an example is illustrated in which the number of concave portions 114*a* is seven and the number of contact portions 114*b* is eight, the number is not particularly limited.

Although FIG. 7 illustrates, as the member 114, the plate-shaped member having concave portions formed at one end of the plate-shaped member, the substantially same effect can be obtained by forming the concave portions at one end of a tapered member. Further, the example in which the concave portion 114*a* is a rectangular concave portion is illustrated. The shape is not limited to the rectangular shape and may be any shape. In the example of FIG. 7, the concave portion 114*a* is illustrated to penetrate in the direction orthogonal to the plane portion of the member 114 (that is, the direction orthogonal to the conveyance direction 10 and the width direction 30). Even if the contact portion does not penetrate, the substantially same effect can be obtained because the frictional force is reduced due to the reduction of the contact portion.

As a way of forming the concave portions 114*a*, cutting with a micro end mill or wire electric discharge machining can be applied, for example.

Hereinafter, the present disclosure is described with reference to examples and comparative examples. The present disclosure is not limited to the examples as described below.

Example 1

The pre-coat liquid and water-based inks of black, cyan, magenta, yellow, and white are filled in an ink container of a modified machine of an inkjet recording apparatus (VC-60000, manufactured by Ricoh Co., Ltd.). Printing is performed with the modified machine. A configuration of the modified machine of the inkjet recording apparatus is the configuration illustrated in FIG. 1, and continuous printing is performed using the modified machine of the inkjet recording device under the following printing conditions.

Printing Conditions

Printing speed: 50 m/min

Resolution: 1200×1200 dots per inch (dpi)

Printed image: a solid image of white ink superimposed on a solid image of equal amounts of black, cyan, magenta, and yellow Non-permeable substrate: OPP (Oriented PolyPropylene) film 20 μm (PYLEN P2161, available from TOYOBO CO., LTD.)

Corona processing apparatus: discharge amount of corona is 20 W·min/$m^2$

Pre-coating liquid applier: coating roller

Dryer immediately after application of pre-coating liquid: warm-air drying (temperature of warm air is 80° C. and wind speed is 20 m/s)

Warm-air dryer for ink: temperature of warm air is 150° C. and wind speed is 20 m/s Warm-air drying nozzle width: 6 mm Diameter of temperature controller: 80 mm Temperature control device: external chiller circulating water Adjustment temperature: 70° C.

Linearly-contact member: tapered members (stainless steel)

Thickness of linearly-contact member: 150 μm, end thickness is 50 μm

Evaluations

After of the printing is performed under the conditions in Example 1 described above, film quality of printed objects is evaluated according to the following methods and evaluation criteria.

Film Quality

The film quality of the printed image at the end of printing was visually observed and evaluated according to the following criteria. The ranks A, B, and C are evaluated as being practically usable.

Evaluation Criteria

A: No abnormality is observed in a printed image.

B: Wrinkles can be observed on a film with a magnifying glass, although the wrinkles cannot be visually observed.

C: Very few wrinkles can be visually observed on the printed image with naked eyes.

D: Wrinkles can be visually observed on the entire printed image.

Example 2

In Example 2, the evaluation was performed in the same manner as the printing conditions in Example 1 except that the "linearly-contact member" was changed from a tapered member to the plate-shaped member having a uniform thickness.

Example 3

In Example 3, the evaluation was performed in the same manner as the printing conditions in Example 1 except that the "linearly-contact member" was changed to a tapered member having an end, formed by a micro end mill device, with concave portions having a width of 900 μm and a depth of 50 μm at an interval of 1 mm.

Example 4

In Example 4, the evaluation was performed in the same manner as the printing conditions in Example 1 except that the "linearly-contact member" was changed to a tapered member having an end, formed by a micro end mill device, with concave portions having a width of 700 μm and a depth of 50 μm are formed at 1 mm intervals.

Example 5

In Example 5, the evaluation was performed in the same manner as the printing conditions in Example 1 except that the "linearly-contact member" was changed to a tapered member having an end, formed by a micro end mill device, with concave portions having a width of 500 μm and a depth of 50 μm are formed at 1 mm intervals.

Example 6

In Example 6, the evaluation was performed in the same manner as the printing conditions in Example 1 except that the "linearly-contact member" was changed to a tapered member having an end, formed by a micro end mill device, with concave portions having a width of 300 μm and a depth of 50 μm are formed at 1 mm intervals.

Example 7

In Example 7, the evaluation was performed in the same manner as the printing conditions in Example 1 except that the "linearly-contact member" was changed to a tapered member having an end, formed by a micro end mill device, with concave portions having a width of 100 μm and a depth of 100 μm are formed at 1 mm intervals.

Example 8

In Example 8, the evaluation was performed in the same manner as the printing conditions in Example 1 except that the "linearly-contact member" was changed to a tapered member having an end, formed by a micro end mill device, with concave portions having a width of 500 μm and a depth of 100 μm are formed at 1 mm intervals.

Example 9

In Example 12, the evaluation was performed in the same manner as the printing conditions in Example 1 except that the "linearly-contact member" was changed to a tapered member having an end, formed by a micro end mill device, with concave portions having a width of 500 μm and a depth of 200 μm are formed at 1 mm intervals.

Example 10

In Example 10, the evaluation was performed in the same manner as the printing conditions in Example 1 except that the "linearly-contact member" was changed to a tapered member having an end with a resin layer having a thickness of 100 μm by spray coating with following fluororesin paint.

Paints

Water-based fluororesin paint (EXTRA Aqua Fluorine, manufactured by Dai Nippon Toryo Co., Ltd.): 10 parts by weight Water: 10 parts by weight Example 11

In Example 11, the evaluation was performed in the same manner as the printing conditions in Example 1 except that the "linearly-contact member" was changed to a tapered member having an end with a resin layer having a thickness of 100 μm by spray coating with following resin paint containing silicone resin fine particles.

Paints

Silicone resin fine particles (Tospearl 120, manufactured by Momentive Performance Materials Inc.): 3 parts by weight Bisphenol Z type polycarbonate (Panlite TS-2050, manufactured by Teijin Chemicals Ltd.): 10 parts by mass 1 Tetrahydrofuran solution of silicone oil (KF50-100CS available from Shin-Etsu Chemical Co., Ltd.): 1 part by mass Tetrahydrofuran: 186 parts by weight Example 12

In Example 12, the evaluation was performed in the same manner as the printing conditions in Example 1 except that the "linearly-contact member" was changed to a tapered member having an end, formed by a micro end mill device, with concave portions having a width of 500 μm and a depth of 50 μm are formed at 1 mm intervals. Subsequently, the evaluation was performed in the same manner as the printing conditions in Example 12 except that the "member that contacts linearly" was changed to a tapered member having an end with a resin layer having a thickness of 100 μm by spray coating with following fluororesin paint.

Paints

Water-based fluororesin paint (EXTRA Aqua Fluorine, manufactured by Dai Nippon Toryo Co., Ltd.): 10 parts by weight Water: 10 parts by weight Example 13

In Example 13, the evaluation was performed in the same manner as the printing conditions in Example 1 except that the "linearly-contact member" was changed to a tapered member having an end, formed by a micro end mill device, with concave portions having a width of 500 μm and a depth of 50 μm are formed at 1 mm intervals. Subsequently, the evaluation was performed in the same manner as the printing conditions in Example 13 except that the "member that contacts linearly" was changed to a tapered member having an end with a resin layer having a thickness of 100 μm by spray coating with following resin paint including silicone resin fine particles.

Paints

Silicone resin fine particles (Tospearl 120, manufactured by Momentive Performance Materials Inc.): 3 parts by weight Bisphenol Z type polycarbonate (Panlite TS-2050, manufactured by Teijin Chemicals Ltd.): 10 parts by mass 1 Tetrahydrofuran solution of silicone oil (KF50-100CS, available from Shin-Etsu Chemical Co., Ltd.): 1 part by mass Tetrahydrofuran: 186 parts by weight Comparative Example 1

In comparative Example 1, the evaluation was performed in the same manner as the printing conditions in Example 1 except that the "linearly-contact member" was not disposed.

Table 1 illustrates the evaluation results of Examples 1 to 13 and Comparative Example 1. As illustrated in the results, according to the present disclosure, good film quality can be obtained.

TABLE 1

| | Film Quality |
|---|---|
| Example 1 | B |
| Example 2 | C |
| Example 3 | B |
| Example 4 | A |
| Example 5 | A |
| Example 6 | A |
| Example 7 | B |
| Example 8 | A |
| Example 9 | B |
| Example 10 | A |
| Example 11 | A |
| Example 12 | A |
| Example 13 | A |
| Comparative Example 1 | D |

According to the apparatus or the liquid discharge apparatus described in each of the above embodiments, it is possible to provide a sufficient drying ability as compared with the comparative example, and to provide a printed output having good film quality.

Illustrative embodiments of the present disclosure have been described above. However, embodiments of the present disclosure are not limited to the above-described embodiments and various modifications are possible within the scope of claims unless explicitly limited in the description.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A device comprising:

a temperature control member having an outer peripheral surface configured to contact a conveyed substrate to which liquid is applied, the temperature control member being configured to heat or cool the substrate; and a linearly-contact member configured to contact the substrate and the temperature control member on an upstream side from a contact position between the substrate and the temperature control member in a conveyance direction of the substrate.

2. The device according to claim 1, further comprising an upstream support member disposed adjacent to the linearly-contact member on the upstream side from the contact position in the conveyance direction of the substrate, wherein the linearly-contact member is disposed between the upstream support member and the contact position.

3. The device according to claim 1, wherein the linearly-contact member is a plate-shaped member.

4. The device according to claim 1, wherein the linearly-contact member is a tapered member whose thickness decreases toward the contact position.

5. The device according to claim 1, wherein the linearly-contact member is configured to contact each of the substrate and the temperature control member in a linear shape parallel to a width direction of the substrate orthogonal to the conveyance direction of the substrate.

6. The device according to claim 1, wherein the linearly-contact member has a concave at an end portion in the conveyance direction of the substrate.

7. The device according to claim 6, wherein a total length of the concave in a width direction of the substrate orthogonal to the conveyance direction of the substrate is 30% or more and 70% or less of a length of the substrate in the width direction.

8. The device according to claim 6, wherein the concave has a depth of 100 μm or less.

9. The device according to claim 1, wherein the linearly-contact member has an end portion configured to contact the substrate and the temperature control member, and wherein the end portion includes a resin layer including fine particles of at least one of fluororesin or silicone resin.

10. A liquid discharge apparatus comprising:

a liquid applier configured to apply liquid onto the substrate; and the device according to claim 1.

* * * * *